US010893767B1

(12) United States Patent
Avery-Payne

(10) Patent No.: US 10,893,767 B1
(45) Date of Patent: Jan. 19, 2021

(54) ADJUSTABLE GARMENT HANGER

(71) Applicant: Addison Avery-Payne, Ridgfield, CT (US)

(72) Inventor: Addison Avery-Payne, Ridgfield, CT (US)

( * ) Notice: Subject to any disclaimer, the term of this patent is extended or adjusted under 35 U.S.C. 154(b) by 0 days.

(21) Appl. No.: 16/524,886

(22) Filed: Jul. 29, 2019

(51) Int. Cl.
*A47G 25/40* (2006.01)
*A47G 25/44* (2006.01)

(52) U.S. Cl.
CPC ..... *A47G 25/4053* (2013.01); *A47G 25/442* (2013.01)

(58) Field of Classification Search
CPC .... A47G 25/4053; A47G 25/14; A47G 25/44; A47G 25/441; A47G 25/442; A47G 25/443; A47G 25/445; A47G 25/447; A47G 25/448; A47G 25/40; A47G 25/4046
USPC ..... 223/94, 85, 89, 90
See application file for complete search history.

(56) References Cited

U.S. PATENT DOCUMENTS 1,015,605 A 1/1912 Wilt
1,015,606 A 1/1912 Wilt
1,054,279 A 2/1913 Corley
1,214,926 A 2/1917 Kimball
1,410,411 A 3/1922 Scofield
3,180,544 A 4/1965 Magiera
3,741,449 A 6/1973 MacKenzie
5,501,376 A 3/1996 Roda-Balzarini
5,975,385 A 11/1999 See
6,158,828 A 12/2000 Vacovsky
6,431,418 B1 8/2002 Pease
6,722,538 B1 4/2004 Hayward
6,811,064 B2 11/2004 Salem
7,182,232 B2 2/2007 Fleming et al.
7,246,729 B2 * 7/2007 Harvey ..... A47G 25/442 223/85
8,028,869 B2 10/2011 Rossaki
9,055,834 B2 6/2015 Zechini
9,402,495 B2 8/2016 Laibe
9,468,326 B2 10/2016 Yip et al.
2004/0016779 A1 1/2004 Salem
2005/0284899 A1 12/2005 Fleming et al.
2007/0119879 A1 5/2007 Escatllar
2007/0261975 A1 11/2007 Rabinoff
2009/0120974 A1 5/2009 Rossaki
2011/0121041 A1 5/2011 Tukulj-Popovic
2012/0223109 A1 9/2012 Wheeler, Sr.
2013/0320051 A1 12/2013 Madden
2014/0076939 A1 * 3/2014 Choi ..... A47G 25/30 223/85
2014/0361053 A1 12/2014 Laibe
2014/0367425 A1 12/2014 Laibe
2015/0028066 A1 1/2015 Zechini (Continued)

*Primary Examiner* — Nathan E Durham
*Assistant Examiner* — F Griffin Hall
(74) *Attorney, Agent, or Firm* — Matthew J Patterson

(57) ABSTRACT

An adjustable garment hanger is disclosed that can accommodate the width and shape of a plurality of different garments. The adjustable garment hanger includes a hanger hook body having a hanger hook leg and an adjustable extension arm having an adjustable extension leg and a retention bracket. The hanger hook leg and the adjustable extension leg are slidably disposed within the retention bracket and configured to adjust the adjustable garment hanger between a maximum length position and a minimum length position.

3 Claims, 2 Drawing Sheets

(56) References Cited

U.S. PATENT DOCUMENTS

| | | | |
|---|---|---|---|
| 2015/0190005 | A1 | 7/2015 | Aspera |
| 2016/0022076 | A1 | 1/2016 | Yip et al. |
| 2016/0235232 | A1 | 8/2016 | Goyal |

* cited by examiner

ADJUSTABLE GARMENT HANGER

BACKGROUND OF THE INVENTION

Field of the Invention

Embodiments of the present disclosure relate to garment hanging systems in general and more particularly to a garment hanger that can be adjusted to fit different sized garments and can last the lifetime of the user.

Description of the Related Art

Garment hangers of the prior art are available in various sizes to accommodate garments for infants through adults. The prior art is also replete with garment hangers that various methods of adjustment. U.S. Pat. No. 4,895,283A discloses a hanger that includes a hanger body having a central portion and two integrally formed arms depending from it. The central portion and arms have forwardly arched contours defining a continuous, forwardly arched contour for the hanger body. A bore is formed in the central portion, and a hook is mounted in the bore for supporting the hanger. Notches are provided in each arm and two hollow shoulder extensions have generally U-shaped cross sections, with one of the shoulder extensions detachably connected to a respective arm. Each of the shoulder extensions has a forwardly arched contour that merges with the forwardly arched contour of the hanger body and a projecting tongue member received in one of the notches. U.S. Pat. No. 5,511,701A discloses an adjustable garment hanger that has extensions which move laterally on a hanger frame. Movement is by manually operated knobs (380) or electric motors using a rack and pinion system. Hanger size corresponds to garment size may be indicated by marks on the perimeter face of a wheel which may be viewed through a window in the frame. The wheel is constrained by a detent ball. U.S. Pat. No. 6,644,520B2 discloses an adjustable hanger having two movable arms, individually slidable along two supporting arms, defining an adjustable garment supporting width. A linkage tongue, coupled to each movable arm, positions in a recess channel in each supporting arm. The supporting arms extend sideways from a medial portion. US20020079340A1 discloses an adjustable garment hanger having an elongated piece having top side, bottom side, inner end, outer end and opposite upright side portions. The elongated piece can press on and over the side portions and top end portions of a garment hanger so that outer end portions extend a selected and variable distance beyond the hanger to support the shoulder and weight of a particular garment. U.S. Pat. No. 9,402,495B2 discloses a hanger that has a coupler including first male coupler connector and second male coupler connector. A first arm comprises first shoulder portion and first female arm connector. A second arm comprises second shoulder portion and second female arm connector. The coupler receives a hook unit the first arm and the second arm, where the hook unit comprises a male hook base connector, the coupler comprises a female hook base connector, and the first and second female arm connectors of the first and second arms comprise first and second female teeth.

A known problem with non-adjustable garment hangers is that a user must replace hangers as the user grows or to accommodate various sized and shaped garments. If the correctly sized garment hanger is not available the conditional of the clothing and ease of storage may suffer. When the garment hangers are replaced they are quite often disposed of, perhaps in landfills. Many of these garment hangers are comprised of plastic which makes the disposal even more deleterious to the environment.

What is needed is an adjustable garment hanger that can accommodate a large variety of sized and shaped garments and which is easily adjustable, sturdy and can be made from a variety of available materials.

SUMMARY OF THE INVENTION

One general aspect includes an adjustable hanger including a retention bracket, a hanger hook main body including a hook, a stationary arm joint, a stationary extension arm and a hanger hook leg, an adjustable extension arm including an adjustable extension leg, an adjustable extension return and an adjustable extension shoulder support, and where the hanger hook leg is disposed adjacent to the adjustable extension leg within the retention bracket.

Implementations may include one or more of the following features. The adjustable hanger where at least one of the hanger hook leg and the adjustable extension leg is slidably disposed within the retention bracket. The adjustable hanger where the hanger hook main body further includes a stationary return positioned between a stationary shoulder support and hanger hook leg, and the adjustable extension arm further including an adjustable extension inner arm connected to the adjustable extension shoulder support by an adjustable extension joint and extending towards the stationary shoulder support. The adjustable hanger further including a maximum length position between the stationary return and the adjustable extension return and a minimum length position between the stationary return and the adjustable extension return. The adjustable hanger may also include where the hanger hook leg and the adjustable extension leg are configured to slidably infinitely adjust between the maximum length position and the minimum length position. The adjustable hanger where the hanger hook main body and the adjustable extension arm are included of a width and a thickness and having a moment of inertia configured to produce a predetermined torsional stiffness. The adjustable hanger where the predetermined torsional stiffness is selected to enable the at least one of the hanger hook leg and the adjustable extension leg to slidably translate relative to the retention bracket. The adjustable hanger where the hanger hook leg and the adjustable extension leg are configured to slidably infinitely adjust to accommodate a width of a garment. The adjustable hanger further including the hanger hook leg having a stationary stop, the adjustable extension leg having an adjustable extension stop, the retention bracket having a first bracket end and a second bracket end, and where the stationary stop abuts the first bracket end and the adjustable extension stop abuts the second bracket end in the maximum length position. The adjustable hanger where the first bracket end includes a first radiused shape and the second bracket end includes a second radiused shape. The adjustable hanger where at least one of the retention bracket, the hanger hook main body and the adjustable extension arm is included of a sustainable material and is selected from at least one of bamboo, wood, sawdust, compressed cardboard, and plant-based polyurethane rigid foam.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the following detailed description of the embodiments, reference is made to the accompanying drawings, which form a part hereof, and within which are shown by way of illustration specific embodiments by which the examples described herein may be practiced. It is to be understood that other embodiments may be utilized and structural changes may be made without departing from the scope of the disclosure.

Figure 1:
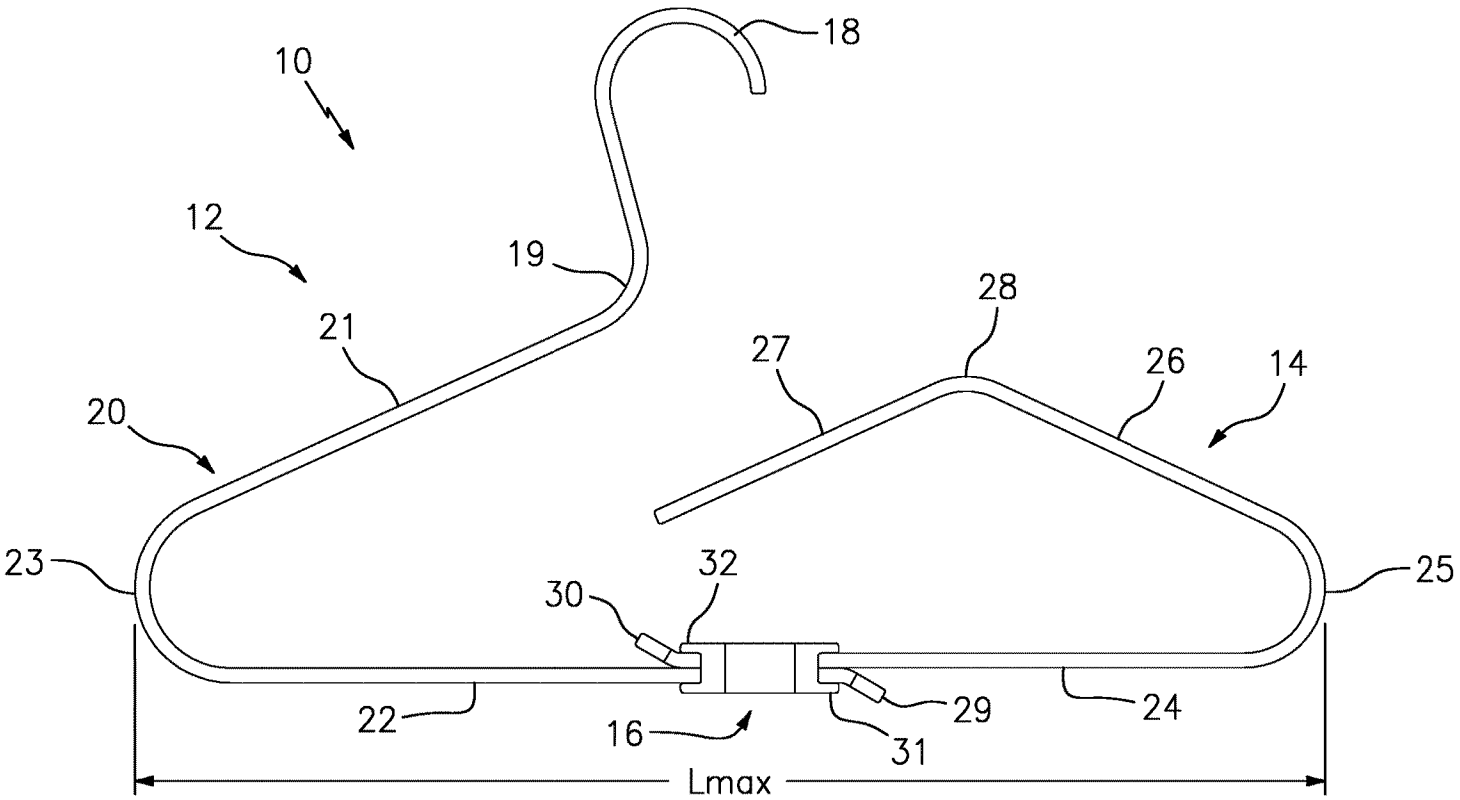
FIG. 1 is a side view of an adjustable garment hanger system in accordance with certain embodiments of the present disclosure.

With reference to FIG. 1, there is shown an adjustable garment hanger 10 having a hanger hook main body 12, an adjustable extension arm 14 and retention bracket 16. Hook main body 12 further includes a hook 18, a stationary arm joint 19, a stationary extension arm 20 and a hanger hook leg 22. Stationary extension arm 20 also includes a stationary shoulder support 21 and stationary return 23 positioned between the stationary shoulder support and hanger hook leg 22. Adjustable extension arm 14 further includes an adjustable extension leg 24, adjustable extension return 25, an adjustable extension shoulder support 26 and an adjustable extension inner arm 27 connected to the adjustable extension shoulder support by adjustable extension joint 28. Although adjustable extension joint 28 is disclosed as a joint in this particular embodiment it is rigid and serves to join adjustable extension shoulder support 26 and an adjustable extension inner arm 27. Hanger hook leg 22 also includes a stationary stop 29 and adjustable extension leg 24 includes an adjustable extension stop 30. Hanger hook leg 22 is disposed within retention bracket 16 and adjustable extension leg 24 is disposed adjacent to the hanger hook leg in a slidable arrangement as will be discussed in more detail herein after. Retention bracket 16 may be comprised of multiple pieces that are assembled over hanger hook leg 22 and adjustable extension leg 24 disposing them therein. In some embodiments of the present disclosure hanger hook leg 22 and adjustable extension leg 24 are in a slidable arrangement with retention bracket 16. In other embodiments of the present disclosure hanger hook leg 22 is fixed to retention bracket 16 and adjustable extension leg 24 is positioned in a slidable arrangement with retention bracket 16 and hanger hook leg 22. In still other embodiments of the present disclosure adjustable extension leg 24 is fixed to retention bracket 16 and hanger hook leg 22 is positioned in a slidable arrangement with retention bracket 16 and hanger hook leg 22. In the embodiment show, adjustable garment hanger 10 is positioned in a maximum length position at L1 with stationary stop 29 abutting a first bracket end 31 of retention bracket 16 and adjustable extension stop 30 abutting a second bracket end 32 of the retention bracket. It should be appreciated by those skilled in the art that with adjustable garment hanger positioned at length L1 the adjustable garment hanger would remain in balance with a garment draped over stationary extension arm 20 and adjustable extension shoulder support 26 when hook 18 is hung on a rod (not shown).

Figure 2:
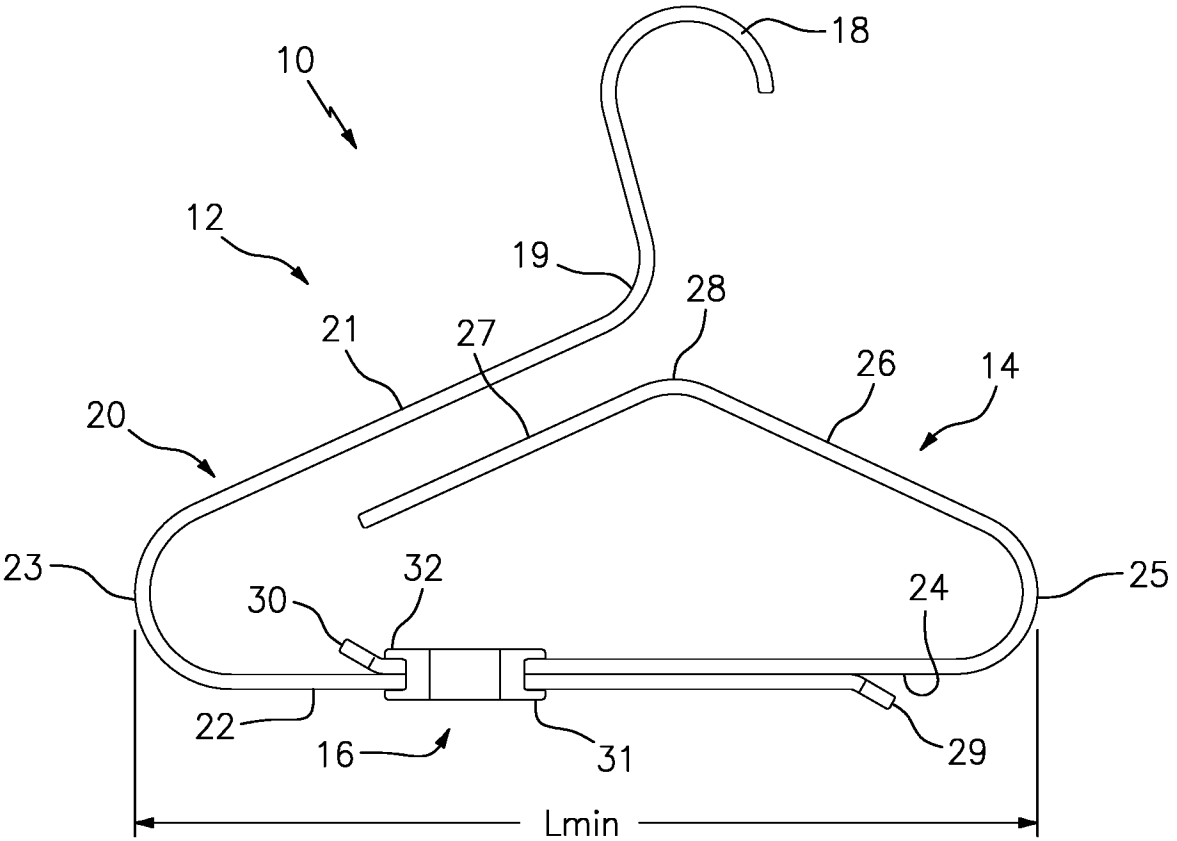
FIG. 2 is a side view of an adjustable garment hanger system in accordance with certain embodiments of the present disclosure.

Referring now to FIG. 2, there is shown adjustable garment hanger 10 positioned at an intermediate width position at L2 wherein hanger hook leg 22 has been translated relative to extension leg 24 and stationary stop 29 does not abut first bracket end 31 of retention bracket 16. In this particular embodiment, adjustable extension stop is 30 in contact with retention bracket 16 and while at L2 is positioned along hanger hook leg 22 proximate adjustable extension return 25. It should be appreciated by those skilled in the art that with adjustable garment hanger positioned at length L2 the arc of adjustable extension joint 28 is approximately aligned with the arc of stationary arm joint 19 such the adjustable garment hanger would remain in balance with a garment draped over stationary extension arm 20 and adjustable extension shoulder support 26 when hook 18 is hung on a rod (not shown). It should be further appreciated that adjustable garment hanger 10 can be positioned at an infinite number of lengths including those less than L2 up to an including a minimum length wherein extension inner arm 27 abuts stationary shoulder support 21.

The operation of adjustable garment hanger 10 is best disclosed with reference to FIG. 1 and FIG. 2. When adjustable garment hanger 10 is used with clothing sized to fit an infant, or otherwise shaped with a relatively small width, a user can grasp the adjustable garment hanger near stationary return 23 and adjustable extension return 25 simultaneously and urge adjustable extension arm 14 toward stationary extension arm 20 causing hanger hook leg 22 to slidably translate relative to adjustable extension leg 24 which causes the length of the adjustable garment hanger to be reduced. Similarly, when adjustable garment hanger 10 is used with clothing sized to fit an adult, or otherwise shaped with a relatively larger width, a user can grasp the adjustable garment hanger near stationary return 23 and adjustable extension return 25 simultaneously and urge adjustable extension arm 14 away from stationary extension arm 20 causing hanger hook leg 22 to slidably translate relative to adjustable extension leg 24 which causes the length of the adjustable garment hanger to be increased. Inventively, adjustable garment hanger 10 is in constant symmetrical balance, at any length, about the center of hook 18 with the adjustment or movement of a single arm. In embodiments of the present disclosure the adjustable length of adjustable garment hanger can be the distance between the outside of stationary return 23 and the outside of adjustable extension return 25. In certain applications, such as with garments with sleeves, it is preferable to position stationary return 23 and adjustable extension return 25 at or near the intersection of the shoulder portion of the garment and the opening of the sleeve. When a particular garment is applied to an adjustable garment hanger 10 for the first time a user can drape the garment over the adjustable garment hanger and adjust the length such that the garment is releasable secured to the hanger and such that the garment hangs in a way that does not produce wrinkles or in a way that produces other deleterious effects on the garment. For instance, a user can begin the use of adjustable garment hanger 10 in the length of L2 and position a garment over the adjustable extension arm 14 toward stationary extension arm 20. It should be noted that this operation is especially useful for garments having a closed neckline. Once the garment is draped over adjustable garment hanger 10, the user can grasp the adjustable garment hanger through the garment near stationary return 23 and adjustable extension return 25 simultaneously and urge adjustable extension arm 14 away from stationary extension arm 20 and positioning stationary return 23 and adjustable extension return 25 at or near the intersection of the shoulder portion of the garment and the opening of the sleeve, or at a predetermined or preferred position of the user.

It should be noted in the embodiment shown in FIGS. 1 and 2 that stationary shoulder support 21 and adjustable extension inner arm 27 are approximately parallel to each other which allows for a very small length to be achieved at a minimum length position. It should be further appreciated by those skilled in the art that adjustable extension joint 28 and adjustable extension inner arm 27 provide support to a garment draped over adjustable garment hanger 10. In addition, the radiused geometry of adjustable extension joint 28 ensures that a garment does not catch on 14 when is positioned on adjustable garment hanger 10.

Figure 3:
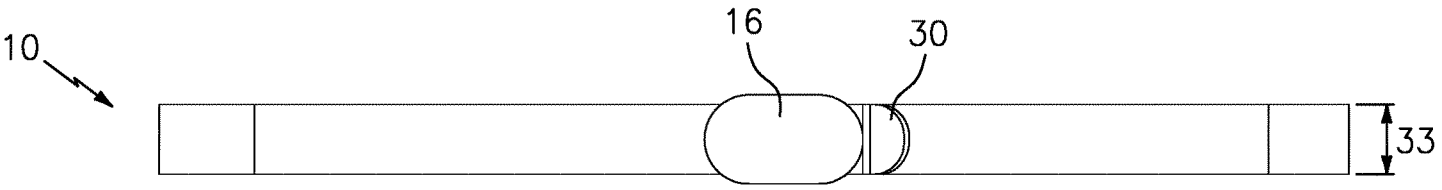
FIG. 3 is a bottom view of an adjustable garment hanger system in accordance with certain embodiments of the present disclosure.

Now referring to FIG. 3, there is shown a bottom view of adjustable garment hanger 10 disclosing the width 33 of hanger hook leg 22 and adjustable extension leg 24 positioned within retention bracket 16. In certain embodiments the width 33 of hanger hook main body 12 and adjustable extension arm 14 are uniform. It should be appreciated by those skilled in the art that width 33 is large when compared to garment hangers of the prior art and this width, along with thickness and choice of material, produces a high moment of inertia of the structure of adjustable garment hanger 10. This high moment of inertia increases both the bending stiffness and the torsional stiffness of adjustable garment hanger 10 over that of the prior art. With specific regard to the hanger hook leg 22 and the adjustable extension leg 24, this high predetermined torsional stiffness is selected to enable their slidable engagement within retention bracket 16 without binding or sticking. It should be noted that first bracket end 31 and second bracket end 32 include a radiused shape which further prevents binding or sticking when hanger hook leg 22 and the adjustable extension leg 24 are translated relative to the retention bracket. With specific regard to the high bending stiffness, it enables the inventive open nature of adjustable garment hanger 10 wherein adjustable extension arm 14 is cantilevered from hanger hook main body 12.

Again, with reference to FIG. 1, adjustable garment hanger 10 illustrating the position of hanger hook leg 22 within retention bracket 16. As shown, in this particular embodiment hanger hook leg 22 is surround by retention bracket 16. Also shown in this view, adjustable extension leg 24 is also positioned within and surrounded by retention bracket 16.

It is within the scope of the present disclosure that adjustable garment hanger 10 may be comprised of many different materials and may be manufactured using any known method. It is an important aspect of the present disclosure that adjustable garment hanger 10 may be comprised of a sustainable material such as bamboo, wood, sawdust, compressed cardboard, plant-based polyurethane rigid foam, as well as materials derived from sustainable materials and composite materials comprised of sustainable materials. In addition, adjustable garment hanger 10 may be comprised of recycled materials such as recycled metals, plastics and wood, among others.

While foregoing is directed to the preferred embodiment of the present invention, other and further embodiments of the invention may be devised without departing from the basic scope thereof, and the scope thereof is determined by the claims that follow.

What is claimed is:

1. An adjustable hanger comprising:

a retention bracket;

a hanger hook main body comprising a hook, a stationary arm joint, a stationary extension arm and a hanger hook leg;

an adjustable extension arm comprising an adjustable extension leg, an adjustable extension return and an adjustable extension shoulder support;

wherein the hanger hook leg is disposed adjacent to the adjustable extension leg within the retention bracket;

at least one of the hanger hook leg and the adjustable extension leg is slidably disposed within the retention bracket;

the hanger hook main body further comprises a stationary return positioned between a stationary shoulder support and the hanger hook leg;

the adjustable extension arm further comprises an adjustable extension inner arm connected to the adjustable extension shoulder support by an adjustable extension joint and extending towards the stationary shoulder support;

further comprising a maximum length position between the stationary return and the adjustable extension return and a minimum length position between the stationary return and the adjustable extension return;

wherein the hanger hook leg and the adjustable extension leg are configured to slidably infinitely adjust between the maximum length position and the minimum length position;

the hanger hook leg having a stationary stop;

the adjustable extension leg having an adjustable extension stop;

the retention bracket having a first bracket end and a second bracket end; and wherein the stationary stop abuts the first bracket end and the adjustable extension stop abuts the second bracket end in the maximum length position.

2. The adjustable hanger of claim 1, wherein the first bracket end comprises a first radiused shape and the second bracket end comprises a second radiused shape.

3. The adjustable hanger of claim 1, wherein at least one of the retention bracket, the hanger hook main body and the adjustable extension arm is comprised of a material selected from the group consisting of bamboo, wood, sawdust, compressed cardboard, and plant-based polyurethane rigid foam.

* * * * *